US006441546B1

(12) United States Patent
Arai

(10) Patent No.: US 6,441,546 B1
(45) Date of Patent: Aug. 27, 2002

(54) SHADOW MASK ASSEMBLY WITH THREE THERMAN EXPANSION COEFFICIENTS

(75) Inventor: Shinji Arai, Shiga (JP)

(73) Assignee: NEC Corporation, Tokyo (JP)

( * ) Notice: Subject to any disclaimer, the term of this patent is extended or adjusted under 35 U.S.C. 154(b) by 180 days.

(21) Appl. No.: 09/645,409

(22) Filed: Aug. 25, 2000

(30) Foreign Application Priority Data

Aug. 27, 1999 (JP) ..... 11-240746/1999

(51) Int. Cl.[7] ..... H01J 29/80
(52) U.S. Cl. ..... 313/402; 313/407
(58) Field of Search ..... 313/402, 404, 313/405, 407

(56) References Cited

FOREIGN PATENT DOCUMENTS

JP 8-77936 3/1996

*Primary Examiner*—VIP Patel
(74) *Attorney, Agent, or Firm*—McGinn & Gibb, PLLC

(57) ABSTRACT

A shadow mask assembly is provided, which reduces the necessary tensile force to be applied to the shadow mask and the weight and fabrication cost of the assembly itself. This assembly is comprised of (a) a pair of bars arranged in substantially parallel at a specific distance; the pair of bars being made of metal having a first thermal expansion coefficient; (b) a pair of arms fixed to the pair of bars in such a way that each of the pair of arms links the pair of arms together; the pair of arms applying a force that moves the pair of bars away from each other; the pair of arms being made of metal having a second thermal expansion coefficient; the pair of arms constituting a frame having an approximately rectangular opening along with the pair of bars; and (c) a shadow mask fixed to the pair of the bars so as to cover the opening of the frame; the shadow mask being applied with a tensile force in a direction approximately perpendicular to the pair of bars due to the force of the pair of arms that moves the pair of bars away from each other, thereby keeping the mask in its specific shape; the shadow mask being made of metal having a third thermal expansion coefficient that is low enough for suppressing the doming phenomenon; the third thermal expansion coefficient of the mask being less than the second thermal expansion coefficient of the pair of arms.

10 Claims, 2 Drawing Sheets

SHADOW MASK ASSEMBLY WITH THREE THERMAN EXPANSION COEFFICIENTS

BACKGROUND OF THE INVENTION

1. Field of the Invention

The present invention relates to a shadow mask assembly and a color cathode-ray tube (CRT) having the same and more particularly, to a shadow mask assembly having a structure to fix the shadow mask to the frame under application of a tensile force thereto, thereby keeping the mask in a specific shape, and a color CRT equipped with the assembly.

2. Description of the Related Art

Shadow-mask type color CRTs have been used extensively and most popular. In color CRTs of this type, the shadow mask is usually shaped to form part of a spherical surface. Since the shadow mask is fixed in the neighborhood of a face panel made of glass, the face panel needs to be shaped to form part of a spherical surface as well.

In recently years, there has been the tendency that the face panel is shaped to form part of a cylindrical or flat surface. This s due to the fact that the visibility of the color CRTs can be improved. In this case, it is needless to say that the face panel needs to be shaped to form part of a cylindrical or flat surface according to the shape of the mask.

However, as known well, the shadow mask is formed by an extremely thin, rectangular metal plate and has a lot of regularly-arranged small apertures for color selection and thus, its mechanical rigidity is extremely low. As a result, the mask is unable to keep its cylindrical or flat shape without application of any external force. Thus, it is usual that a proper tensile force or two is/are applied to the flat mask in a direction or two when the mask is fixed to the frame, thereby applying a proper tensile force to the mask in a desired direction to keep it in a desired cylindrical or flat shape.

An example of the structure to fix the shadow mask to the frame under application of a tensile force to the mask is disclosed in the Japanese Non-Examined Patent Publication No. 8-77936 published in March 1996, which is explained below with reference to FIG. 1.

As shown in FIG. 1, the prior-art shadow mask assembly 200 is comprised of a pair of curved bars 201*a* and 201*b*, a pair of arms 202*a* and 202*b*, and a rectangular shadow mask 203. The pair of bars 201*a* and 201*b* are fixed to the pair of arms 202*a* and 202*b*, thereby constituting the frame that supports the mask 203.

Each of the bars 201*a* and 201*b* has an L-shaped cross section and is curved to form part of a cylindrical surface. Each of the arms 202*a* and 202*b* is bent to have a shape like a U letter. The ask 203, which is curved to form part of a cylindrical surface, has a lot of regularly-arranged small apertures 204 allowing three electron beams for red (R), green (G), and blue (B) to pass through for color selection.

The two opposite ends of the mask 203 are fixed by welding to the curved top faces of the bars 201*a* and 201*b*, respectively. Thus, the mask 203 covers or closes the rectangular opening formed by the bars 201*a* and 201*b* and the arms 202*a* and 202*b* (i.e., formed by the frame). In this state, the arms 202*a* and 202*b* have elastic forces that translate respectively the bars 201*a* and 201*b* outwardly. Due to these elastic forces, the fixed ends of the mask 203 are pulled so as to be apart from each other. As a result, a tension that translate the fixed ends of the mask 203 to be apart from each other is generated in the mask 203, thereby keeping the shape of the mask 203.

According to the Publication No. 8-77936, the bars 201*a* and 201*b* and the arms 202*a* and 202*b* (which constitute the frame) are made of chromium-system stainless steel while the shadow mask 203 is made of iron.

The Publication No. 8-77936 does not disclose any fabrication method of the prior-art shadow mask assembly 200. However, it is supposed that the assembly 200 is fabricated in the following way.

First, the two ends of the arm 202*a* are fixed by welding to the specific positions of the bars 201*a* and 201*b*, respectively. Similarly, the two ends of the arm 202*b* are fixed by welding to the specific positions of the bars 201*a* and 201*b*, respectively. Thus, the bars 201*a* and 201*b* are apart from each other by a specific distance and arranged in parallel, constituting the frame having an approximately rectangular shape.

Subsequently, the bars 201*a* and 201*b* are applied with an external force or forces to be shifted nearer, thereby slightly bending the ends of the arms 202*a* and 202*b* inwardly. Next, while the ends of the arms 202*a* and 202*b* are kept bent inwardly, the two opposite ends of the mask 203 are respectively fixed to the curved top faces of the bars 201*a* and 201*b* by welding. Thereafter, the application of the external force or forces is stopped, allowing the ends of the arms 202*a* and 202*b* to return to their original positions. Thus, an outward elastic force that moves the bars 201*a* and 201*b* to be apart from each other is generated, applying a specific tensile force to the mask 203 in a direction perpendicular to the bars 201*a* and 201*b*. Due to the specific tensile force, the desired shape of the mask 203 can be kept unchanged in spite of its extremely low mechanical rigidity.

Generally, when the color CRT is operated, large part of he R, G, and B electron beams collide with the mask 203, raising he temperature of the mask 203 to near 100° C. Due to this temperature rise, the mask 203 is partially expanded thermally to hereby induce undesired positional shift of the apertures 204. In this state, the R, G, and 5 electron beams tend to land in error on the phosphor screen located between the mask 203 and the face panel, degrading the color purity. This phenomenon is termed the "doming".

The tensile force applied to the shadow mask 203 serves not only to hold its shape but to prevent the doming phenomenon. Thus, if the mask 203 has a large thermal expansion coefficient, the tensile force needs to be increased according to the value of the coefficient.

With the prior-art shadow mask assembly 200 shown in FIG. 1, the s shadow mask 203 is made of iron and therefore, the thermal expansion coefficient of the mask 203 is as large as approximately $120\times10^{-7}$/° C. at room temperature. Thus, to absorb the thermal expansion of the mask 203 and to mechanically hold the desired shape of the mask 203 securely, the necessary tensile force is as high as approximately 500 to 1000 kg. As a result, the bars 201*a* and 201*b* and the arms 202*a* and 202*b* need to be stronger according to the magnitude of the tensile force applied, which raises the weight and fabrication cost of the assembly 200.

Moreover, a large pressing force or forces need to be applied to the arms 202*a* and 202*b* in the welding process for the mask 203 and therefore, large-scale, expensive facilities are required for this purpose. This makes the fabrication cost of the assembly 200 higher.

SUMMARY OF THE INVENTION

Accordingly, an object of the present invention is to provide a shadow mask assembly that reduces the necessary tensile force to be applied to the shadow mask, and a color CRT equipped with the assembly.

Another object of the present invention is to provide a shadow mask assembly that reduces the weight and fabrication cost of the shadow mask assembly, and a color CRT equipped with the assembly.

Still another object of the present invention is to provide a shadow mask assembly that requires no large-scale, expensive facilities for the purpose of applying the tensile force to the shadow mask, and a color CRT equipped with the assembly.

The above objects together with others not specifically mentioned will become clear to those skilled in the art from the following description.

According to a first aspect of the present invention, a shadow mask assembly is provided, which is comprised of;

(a) a pair of bars arranged in substantially parallel at a specific distance;

the pair of bars being made of metal having a first thermal expansion coefficient;

(b) a pair of arms fixed to the pair of bars in such a way that each of the pair of arms links the pair of bars together;

the pair of arms applying a force that moves the pair of bars away from each other;

the pair of arms being made of metal having a second thermal expansion coefficient;

the pair of arms constituting a frame having an approximately rectangular opening along with the pair of bars; and (c) a shadow mask fixed to the pair of bars so as to cover the opening of the frame;

the shadow mask being applied with a tensile force in a direction approximately perpendicular to the pair of bars due to the force of the pair of arms that moves the pair of bars away from each other, thereby keeping the mask in its specific shape;

the shadow mask being made of metal having a third thermal expansion coefficient that is low enough for suppressing the doming phenomenon;

the third thermal expansion coefficient of the mask being less than the second thermal expansion coefficient of the pair of arms.

With the shadow mask assembly according to the first aspect of the present invention, the shadow mask is made of the metal having the third thermal expansion coefficient that is low enough for suppressing the doming phenomenon and therefore, almost no tensile force is additionally applied to the mask in order to suppress the doming phenomenon. This means that the tensile force for keeping the mask in its specific shape is reduced, in other words, the necessary tensile force to be applied to the mask is lowered.

As a result, the necessary mechanical strength for the pair of bars and the pair of arms can be lowered, which reduces the weight and fabrication cost of the pairs of bars and arms (and therefore, the shadow mask assembly itself). At the same time as this, the necessary force applied to the pair of arms in the welding process can be lowered and thus, no large-scale, expensive facilities are required for the purpose of applying tensile force to the shadow mask.

In a preferred embodiment of the shadow mask assembly according to the first aspect of the invention, the first thermal expansion coefficient of the pair of bars is greater than the second thermal expansion coefficient of the pair of arms. In this embodiment, there is an additional advantage that possible disadvantages due to the thermal expansion difference between the pair of bars and the mask are difficult to occur.

In another preferred embodiment of the shadow mask assembly according to the first aspect of the invention, the first thermal expansion coefficient of the pair of bars is approximately equal to the third thermal expansion coefficient of the shadow mask. In this embodiment, there is an additional advantage that no disadvantage such as plastic deformation and/or wrinkling of the mask occur even if the shadow mask assembly is subjected to the thermal history with the highest temperature of approximately 500° C. in the fabrication processes of color CRTs and to the operation environment with the highest temperature of approximately 100° C. This is because almost no thermal expansion difference is induced between the pair of bars and the mask.

In still another preferred embodiment of the shadow mask assembly according to the first aspect of the invention, the metals of the pair of bars and the shadow mask are Invar (i.e., iron alloy containing nickel by 36%), and the metal of the pair of arms is at least one selected from the group consisting of iron, chromium-iron alloy, and chromium-iron-molybdenum alloy.

According to a second aspect of the present invention, a color CRT is provided, which is comprised of the shadow mask assembly according to the first aspect of the invention.

With the color CRT according to the second aspect of the invention, the shadow mask assembly according to the first aspect of the invention is included and thus, a light-weight, inexpensive color CRT with high image-quality can be realized.

BRIEF DESCRIPTION OF THE DRAWINGS

In order that the present invention may be readily carried into effect, it will now be described with reference to the accompanying drawings.

DETAILED DESCRIPTION OF THE PREFERRED EMBODIMENTS

Figure 1:
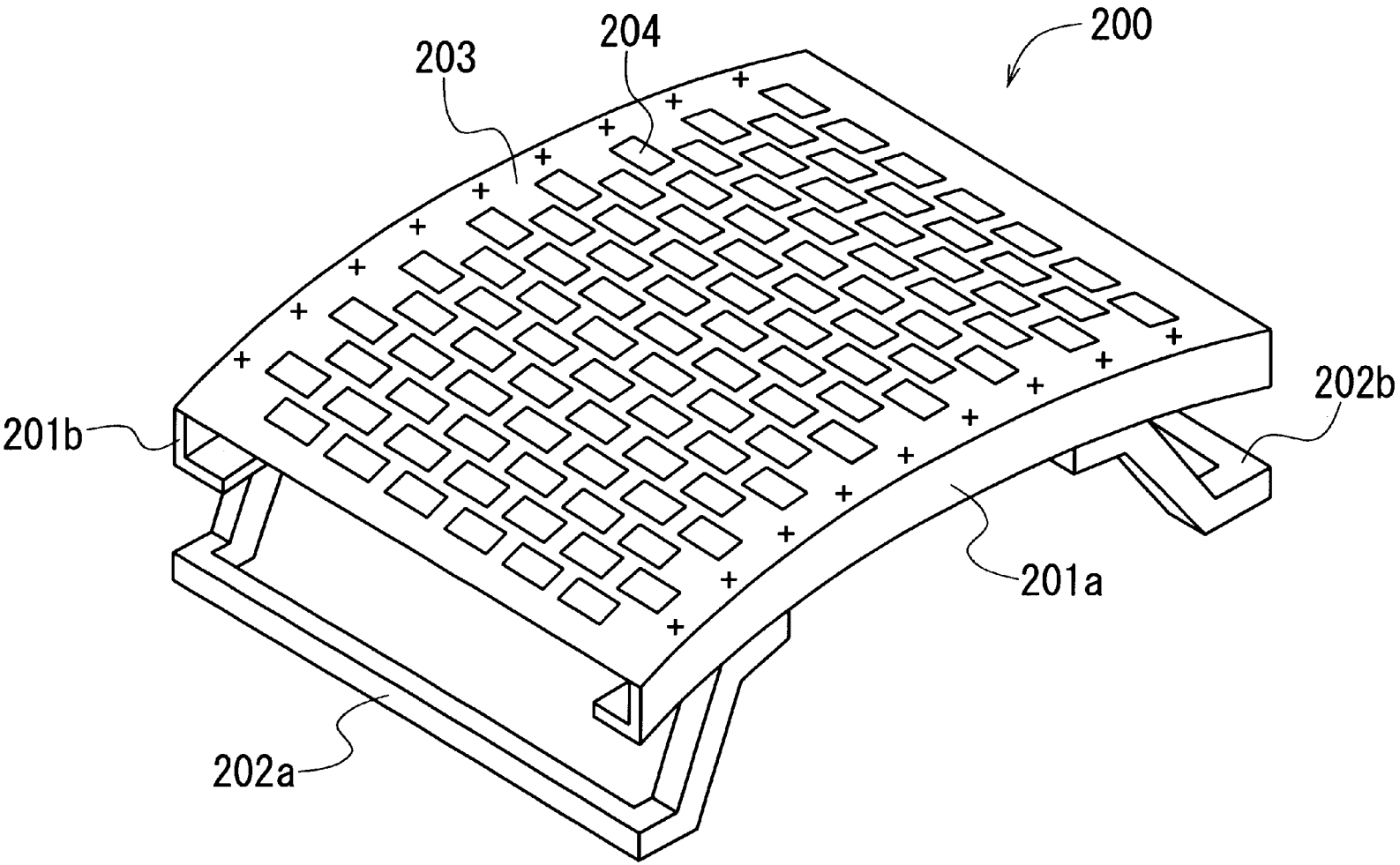
FIG. 1 PRIOR ART
FIG. 1 is a schematic perspective view showing the configuration of a prior-art shadow mask assembly designed for color CRTs.

Preferred embodiments of the present invention will be described in detail below while referring to the drawings attached.

Figure 2:
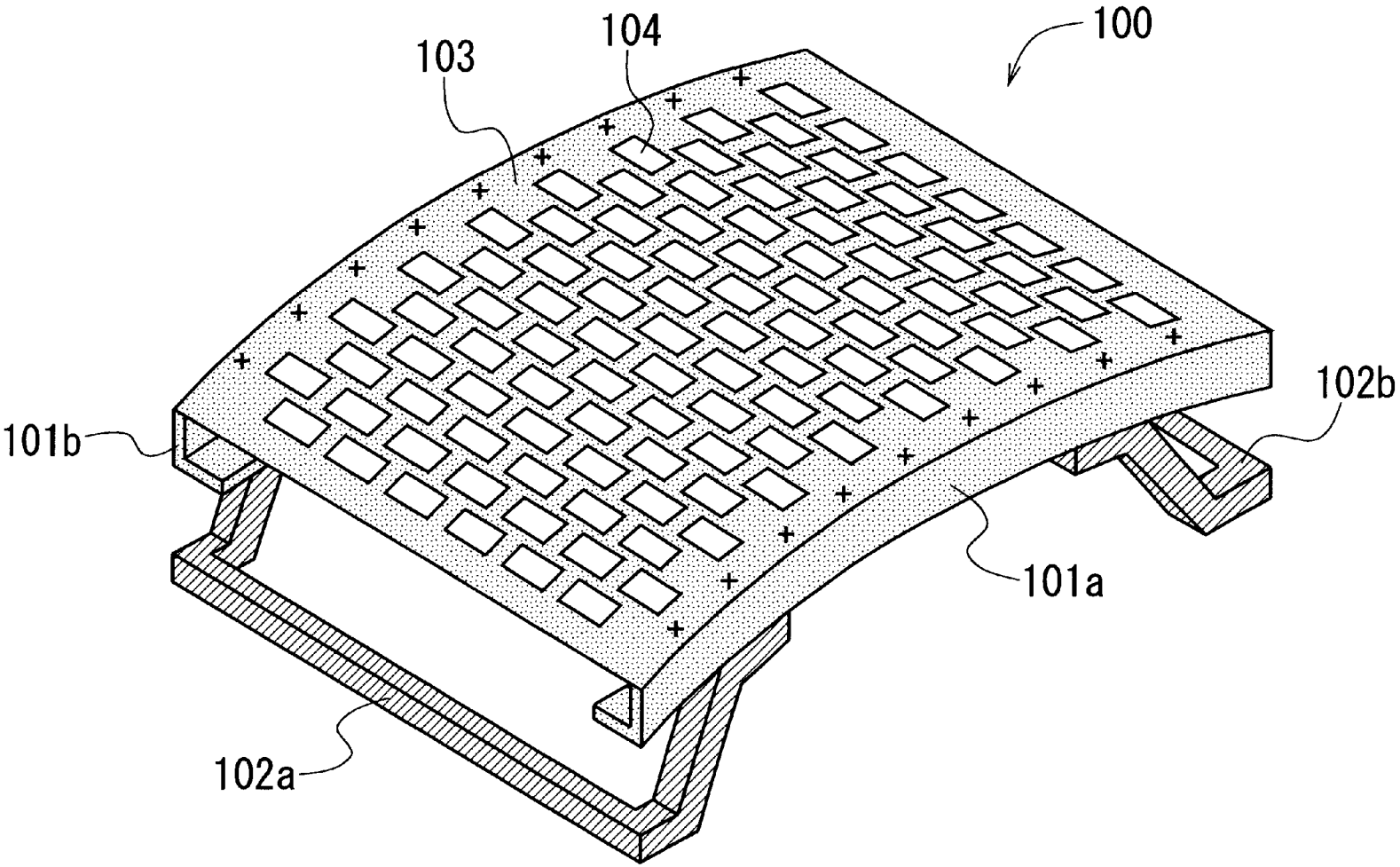
FIG. 2 is a schematic perspective view showing the configuration of a shadow mask assembly designed for color CRTs according to an embodiment of the present invention.

As shown in FIG. 2, a shadow mask assembly 100 according to an embodiment of the invention is comprised of a pair of curved bars 101*a* and 101*b* arranged in parallel at a specific distance, a pair of arms 102*a* and 102*b* fixed to the bars 101*a* and 101*b* and arranged at a specific distance, and a rectangular shadow mask 103 fixed to the bars 101*a* and 101*b*.

The pair of arms 102*a* and 102*b* are fixed to the pair of bars 101*a* and 101*b* in such a way that each of the arms 102*a* and 102*b* links the bars 101*a* and 101*b* together, thereby constituting the frame that supports the mask 103.

Each of the bars 101*a* and 101*b* has an L-shaped cross section and is curved to form part of a cylindrical surface. Each of the arms 102*a* and 102*b* is bent to have a shape like a U letter. The mask 103, which is curved to form part of a cylindrical surface, has a lot of regularly-arranged small apertures 104 allowing the R, G, and B electron beams to pass through the mask 103 for color selection.

The two opposite ends of the mask 103 are fixed by welding to the curved top faces of the bars 101*a* and 101*b*, respectively. Thus, the mask 103 covers or closes the rectangular opening formed by the bars 1O1*a* and 101*b* and the arms 102*a* and 102*b* (i.e., formed by the frame). In this state, the arms 102*a* and 102*b* have elastic forces that translate respectively the bars 101*a* and 101*b* outwardly. Due to these elastic forces, the fixed ends of the mask 103 are pulled to be apart from each other. As a result, a tension that translate the fixed ends of the mask 103 to be away from each other is generated in the mask 103, thereby keeping the curved shape of the mask 103.

The bars 101*a* and 101*b* and the shadow mask 103 are made of an Invar alloy (i.e., iron alloy containing nickel by 36%) having a thermal expansion coefficient as low as approximately $10\times10^{-7}/°$ C., which is sufficiently low to suppress the doming phenomenon. Here, the arms 102*a* and 102*b* are made of iron.

The fabrication method of the shadow mask assembly 100 is the same as that explained in the prior-art assembly 200 and thus, the explanation on it is omitted here.

With the shadow mask assembly 100 according to the embodiment of the invention, the shadow mask 103 is made of Invar and therefore, the thermal expansion coefficient of the mask 103 is approximately one-tenth (1/10) of the thermal expansion coefficient of the mask 203 made of iron (i.e., $120\times10^{-7}/°$ C.), which is low enough for suppressing the doming phenomenon. Thus, almost no tensile force is additionally applied to. the mask 103 in order to suppress the doming phenomenon. This means that the tensile force for keeping the mask 103 in its shape is reduced, in other words, the necessary tensile force to be applied to the mask 103 is lowered.

As a result, the necessary mechanical strength for the bars 101*a* and 101*b* and the arms 102*a* and 102*b* can be lowered , which reduces the weight and fabrication cost of the bars 101*a* and 101*b* and the arms 102*a* and 102*b* (and therefore, the shadow mask assembly itself) At the same time as this, the necessary force applied to the arms 102*a* and 102*b* in the welding process can be lowered and thus, no large-scale, expensive facilities are required for the purpose of applying tensile force to the shadow mask 103.

Needless to say, any other metal having a desired low thermal expansion coefficient may be used for the metal of the mask 103. In this case, the tensile force can be lowered according to the value of the e coefficient.

In the embodiment, the pair of bars 101*a* and 101*b* are made of Invar as used for the mask 103. Thus, there is an additional advantage that no disadvantage such as plastic deformation and/or wrinkling of the mask 103 occur even if the shadow mask assembly is subjected to the thermal history with the highest temperature of approximately 500° C. in the fabrication processes of color CRTs and to the operation environment with the highest temperature of approximately 100° C. This is because almost no thermal expansion difference is induced between the pair of bars 101*a* and 101*b* and the mask 103.

Any other metal having a desired low thermal expansion coefficient may be used for the bars 101*a* and 101*b* in the present invention. However, it is preferred that Invar is used for the bars 101*a* and 101*b,* because the above-described additional advantage is given.

Unlike this, there is no need to use any metal with a desired low thermal expansion coefficient such as Invar for the arms 102*a* and 102*b,* because the bars 102*a* and 102*b* are not contacted with the mask 103. Although such metal may be used for the arms 102*a* and 102*b,* it is not preferred due to its high cost. It is preferred that any metal producing desired elasticity is selected and used for the arms 102*a* and 102*b* while regarding the cost as important.

For example, iron (Fe), chromium-iron (Cr—Fe) alloy, and/or chromium-iron-molybdenum (Cr—Fe—Mo) alloy is/are preferably used as the metal for the arms 102*a* and 102*b.*

In the above-described embodiment, the mask 103 is curved to form part of a cylindrical surface. However, it is needless to say that the mask 103 may be curved to form part of a flat surface. In this case, any other structure of the assembly is the same as that explained above except that the pair of bars 101*a* and 101*b* are changed to be straight. Thus, no explanation is presented here for the sake of simplification.

While the preferred form of the present invention has been described, it is to be understood that modifications will be apparent to those skilled in the art without departing from the spirit of the invention. The scope of the present invention, therefore, is to be determined solely by the following claims.

What is claimed is:

1. A shadow mask assembly comprising:

(a) a pair of bars arranged in substantially parallel at a specific distance;

the pair of bars being made of metal having a first thermal expansion coefficient;

(b) a pair of arms fixed to the pair of bars in such a way that each of the pair of arms links the pair of arms together;

the pair of arms applying a force that moves the pair of bars away from each other;

the pair of arms being made of metal having a second thermal expansion coefficient;

the pair of arms constituting a frame having an approximately rectangular opening along with the pair of bars; and (c) a shadow mask fixed to the pair of bars so as to cover said opening of said frame;

said shadow mask being applied with a tensile force in a direction approximately perpendicular to the pair of bars due to said force of the pair of arms that moves the pair of bars away from each other, thereby keeping said mask in its specific shape;

said shadow mask being made of metal having a third thermal expansion coefficient that is low enough for suppressing the doming phenomenon;

said third thermal expansion coefficient of said mask being less than said second thermal expansion coefficient of the pair of arms.

2. The assembly according to claim 1, wherein said first thermal expansion coefficient of the pair of bars is greater than said second thermal expansion coefficient of the pair of arms.

3. The assembly according to claim 1, wherein said first thermal expansion coefficient of the pair of bars is approximately equal to said third thermal expansion coefficient of said shadow mask.

4. The assembly according to claim 1, wherein said metals of the pair of bars and said shadow mask are Invar and said metal of the pair of arms is at least one selected from the group consisting of iron, chromium-iron alloy, and chromium-iron-molybdenum alloy.

5. The assembly according to claim 1, wherein each of the pair of bars is curved to form part of a cylindrical surface.

6. A color CRT comprising the shadow mask assembly according to claim 1.

7. A color CRT comprising the shadow mask assembly according to claim 2.

8. A color CRT comprising the shadow mask assembly according to claim 3.

9. A color CRT comprising the shadow mask assembly according to claim 4.

10. A color CRT comprising the shadow mask assembly according to claim 5.

* * * * *